US006662464B2

(12) United States Patent
Treu

(10) Patent No.: US 6,662,464 B2
(45) Date of Patent: Dec. 16, 2003

(54) METHOD AND APPARATUS FOR CLEANING DRYER LINT SCREENS

(76) Inventor: Daniel Mark Treu, 4007 Cinnabar Dr., Eagan, MN (US) 55122-2940

( * ) Notice: Subject to any disclaimer, the term of this patent is extended or adjusted under 35 U.S.C. 154(b) by 0 days.

(21) Appl. No.: 10/077,017

(22) Filed: Feb. 15, 2002

(65) Prior Publication Data

US 2003/0154618 A1 Aug. 21, 2003

(51) Int. Cl.[7] ..... F26B 19/00
(52) U.S. Cl. ..... 34/85; 34/82
(58) Field of Search ..... 34/82, 85; 55/290, 55/352

(56) References Cited

U.S. PATENT DOCUMENTS 2,644,246 A * 7/1953 Robinson ..... 34/55
2,735,507 A * 2/1956 Vogel ..... 183/4.3
3,984,896 A * 10/1976 Hicks ..... 19/23
4,314,409 A * 2/1982 Cartier et al. ..... 34/82
4,435,909 A * 3/1984 Williamson, Jr. ..... 34/82
4,452,613 A * 6/1984 Littrell ..... 55/96
5,199,133 A * 4/1993 Burton ..... 19/39
5,348,030 A * 9/1994 Hirzel ..... 132/123
5,940,986 A * 8/1999 Jelinek et al. ..... 34/528
6,016,610 A * 1/2000 Sears ..... 34/82

* cited by examiner

*Primary Examiner*—K. B. Rinehart
(74) *Attorney, Agent, or Firm*—R. Lawrence Buckley

(57) ABSTRACT

A device (10) for removing lint from a dryer lint screen (14). Device (10) preferably includes a trash container (13) and a trash container lid (12), the latter of which forms a slot (26) for receiving the dryer lint screen (14). Attached to the underside of lid (12) adjacent slot (26) are bristles (40). Lint is removed from the lint screen (14) by inserting it into slot (26) and then withdrawing it. Bristles (40) contact the lint and strip it off of screen (14) as the screen is withdrawn from the slot (26). The lint can then fall into trash container (13) for subsequent disposal.

6 Claims, 3 Drawing Sheets

METHOD AND APPARATUS FOR CLEANING DRYER LINT SCREENS

FIELD OF THE INVENTION

This invention relates generally to lint screens used in clothes dryers, and more particularly to a method and apparatus for cleaning dryer lint screens.

BACKGROUND OF THE INVENTION

Drying laundry using a commercially manufactured clothes dryer is a common household chore. Although the makes and models vary somewhat in design and features, virtually all clothes dryers have a lint screen. The present invention involves the lint screen.

Lint screens are designed to trap lint—fuzz consisting of fine ravelings and short fibers of fabric—as well as miscellaneous "pocket debris" such as shredded tissue or paper. Trapping these materials serves two purposes. Removal of the lint from clothing results in an improved appearance of the clothing and reduces or eliminates an additional task of manually removing lint from the clothing with a lint brush subsequent to washing and drying the items. The screen also prevents the lint and debris from entering the exhaust duct of the dryer system and clogging the system, resulting in possible safety (fire) concerns or unnecessary dryer repair costs.

In order for a lint screen to operate optimally it must be cleaned frequently, preferably after every dryer load. The cleaning process historically involved pulling the screen out of a slot in the dryer, removing the lint from the screen with one's fingers, disposing of the lint, and re-inserting the screen into the slot.

For a variety of reasons, the lint screen cleaning process outlined above frequently doesn't happen. When in a hurry, many people skip the process altogether. Others find it difficult to remove the lint from the screen and delay cleaning the screen until the lint is thick enough to grasp and sweep off more easily with their fingers. This creates a problem, for if the lint is thick enough to easily remove, it is also thick enough to impair the screen's effectiveness as a filter. Elderly people or those with arthritis may have an even more difficult time manually cleaning the lint screens. In addition, some people simply prefer not to touch dryer lint due to its texture, for example. It is conceivable that these individuals could use a hand-held brush of some sort to remove the lint, but this would require that a brush be easily accessible, and necessitate the use of both hands—one to hold the lint screen and one to manipulate the brush. Whether hindered by time constraints, the difficulty of removing lint from a screen or lint squeamishness, the outcome is the same: the lint does not get removed in a timely fashion. The result is increased safety concerns, decreased dryer efficiency, and unnecessary dryer maintenance costs.

Another problem relating to dryer lint screens is that some of the lint can become airborne in the process of removing it from the screen and disposing of it (most commonly in a nearby trash receptacle). This makes additional cleaning in the laundry room necessary and creates a health issue for those who are sensitive or allergic to dust.

Finally, dryer lint is lightweight and difficult to accurately place and retain in an appropriate container. Whether one "misses" the trash container in the first place, or the lint in the container becomes airborne after being placed there, the result will be at best an unsightly mess; at worst, a fire hazard. This problem is particularly common at apartment building laundry rooms or laundromats where the large number of individuals who are using the appliances have no personal investment, and thus minimal concern, for the upkeep of the appliances and the facility.

The aforementioned problems associated with cleaning dryer lint screens are widespread, with potentially serious implications in residential and commercial settings. The present invention addresses the dryer lint disposal problems outlined above. It accomplishes the task of thoroughly cleaning the lint screen quickly and easily, and without the operator having to touch the lint. In a preferred embodiment it requires the use of only one hand, reduces airborne lint and ensures that it is properly and completely disposed of in a standard trash container.

SUMMARY OF THE INVENTION

Accordingly, one embodiment of the present invention includes a device for removing lint from a dryer lint screen, wherein the device includes a frame forming a slot suitable for accepting the lint screen; a lint stripper connected to the frame and arranged adjacent to the lint screen slot; and a container operatively connected to the frame for holding the lint that has been stripped from the lint screen, wherein when the lint screen is inserted into the lint screen slot and then withdrawn the lint is stripped off of the screen by the lint stripper and deposited into the container.

Another embodiment includes a device for removing lint from a dryer lint screen, wherein the device includes a frame forming a slot; and lint stripping media adjacent the slot, wherein the lint stripping media includes a pair of linear media elements on either side of the slot, wherein when the lint screen is inserted into the slot and then withdrawn the lint is stripped off of the lint screen by the linear media elements.

Still another embodiment includes a device for removing lint from a dryer lint screen, including (a) a container; and (b) a lint stripper assembly including a frame and lint stripping media connected to the frame, wherein the frame is operatively connected to the container and the lint is removed from the lint screen by inserting the lint screen into the lint stripper assembly and then withdrawing it, whereupon the lint is stripped off of the screen by the media and collected within the container.

In a preferred embodiment, the "container" is a trash can and the "frame" is a trash can lid.

And in a still further preferred embodiment, the "lint stripping media" includes a plurality of bristles. The bristles can include two sets of bristles facing toward one another and angled downwardly and inwardly, with one set of bristles connected to the underside of the lid and positioned on one side of the slot, and the other set of bristles connected to the underside of the lid and positioned on the other side of the slot.

Further with regard to the preferred embodiment, there can also be a pair of bristle supports connected to the trash can lid and located on either side of the slot, wherein one of the bristle supports is adjacent to and positioned above one of the bristle sets and the other bristle support is adjacent to and positioned above the other bristle set, whereby when the lint screen is inserted the bristles readily flex downwardly and do not appreciably strip lint off of the screen, but when the lint screen is withdrawn the bristles contact the bristle supports and do not flex upwardly as readily thereby stripping the lint off of the screen.

Finally, the device can include a pair of adjoining flexible flaps connected to the top of the lid and located on either side of the slot, whereby the flaps seal the slot so as to prevent airborne lint from escaping the trash can once stripped off of the lint filter.

Additional aspects of the present invention will be described with reference to the appended Drawings.

DETAILED DESCRIPTION OF PREFERRED EMBODIMENT OF INVENTION

Figure 1:
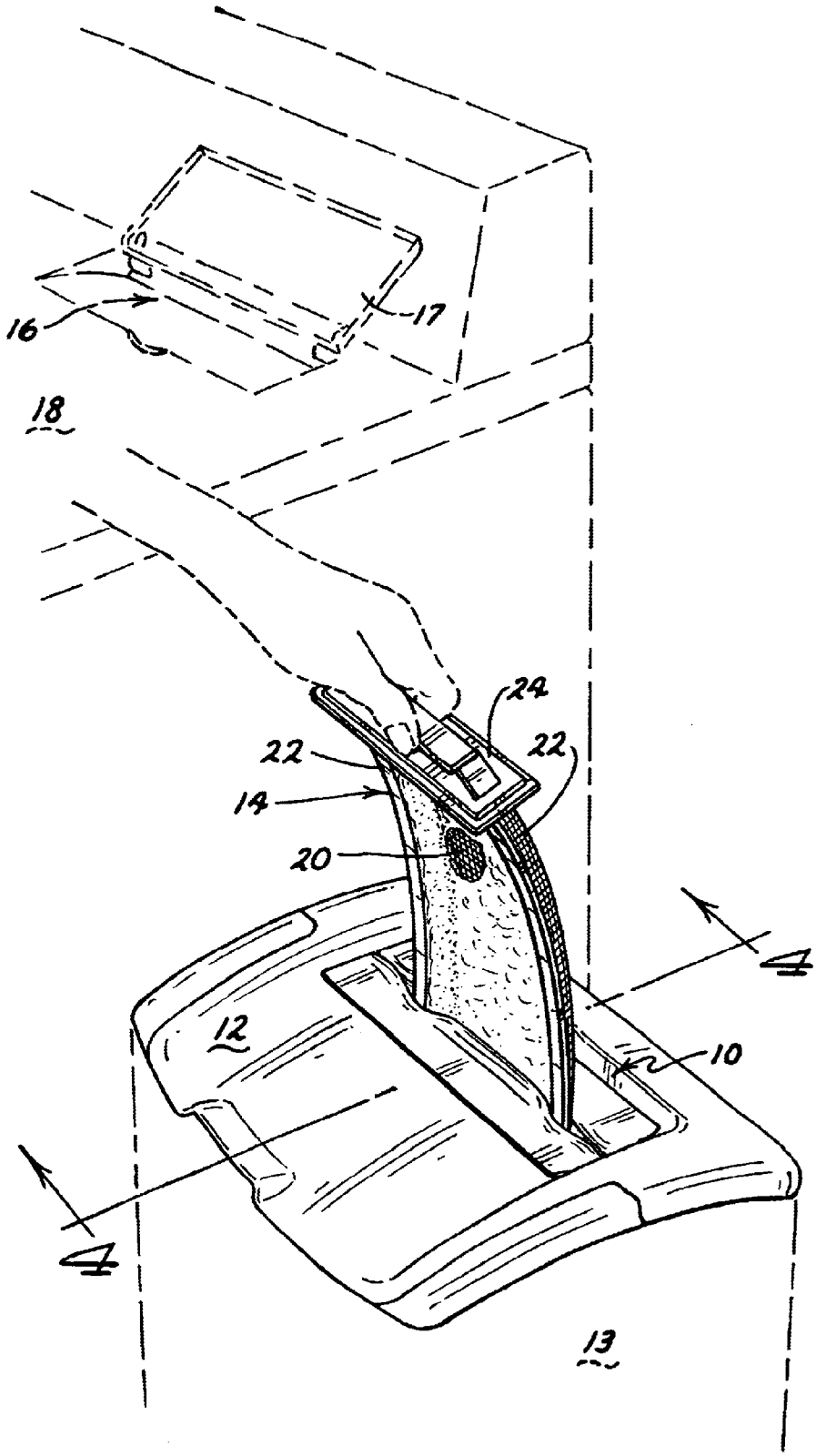
FIG. 1 is a perspective view of a preferred lint screen cleaning device according to the present invention, illustrating the device mounted in a standard trash can lid.

Referring to the Drawings, wherein like reference numerals designate like parts and assemblies throughout the several views, FIG. 1 shows a perspective view of a preferred lint screen cleaner 10 according to the present invention. Preferred lint screen cleaner 10 is incorporated into what would otherwise be a standard trash can. Specifically, preferred cleaner 10 is mounted in and to a standard trash can lid 12, though other mounting techniques are contemplated. Several alternatives are discussed below.

Returning to the preferred embodiment, trash can lid 12 could be a standard plastic molded lid, either foot or hand operated. In general, lid 12 forms the "frame" of the lint screen cleaner, and this terminology will be used from time to time in the course of describing the invention.

Lid 12 sits atop standard trash can 13 in this preferred embodiment, though in other embodiments of the present invention the lid, or "frame," of the lint screen cleaner could be attached to other types of lint containing, handling or disposing devices or systems.

Still referring to FIG. 1, cleaner 10 can accommodate a variety of dryer lint screens, including standard dryer lint screen 14. During operation of dryer 18, lint screen 14 resides in a pocket 16 located conveniently on dryer 18. Screen 14 filters lint from the air being circulated through the laundry. As is well known, lint accumulates on the upstream side of lint screen 14, which, for the typical curved lint screen as shown in the Drawing, is on the concave side of the screen. A door 17 covers pocket 16, and door 17 is closed during operation of dryer 18. Lint screen 14 is removed from dryer 18 by lifting door 17 and reaching down into pocket 16 to grasp screen 14.

Lint screen 14 includes a screen material 20 spanning between a pair of relatively long, gently curved side rails 22, along their entire length. Screen material 20 is a metal or plastic mesh having a hole size small enough to trap fine lint particles. A handle 24 is mounted on one end of the lint screen, also spanning between side rails 22. Lint screen 14 could be about 18 inches long, measured along the curved side rails 22; and about 12 inches wide, from side rail to side rail. The present invention can accommodate lint screens having alternative constructions and sizes, as well. In fact, cleaner 10 can easily be sized and configured to receive and clean a wide variety of lint screens.

Figure 2:
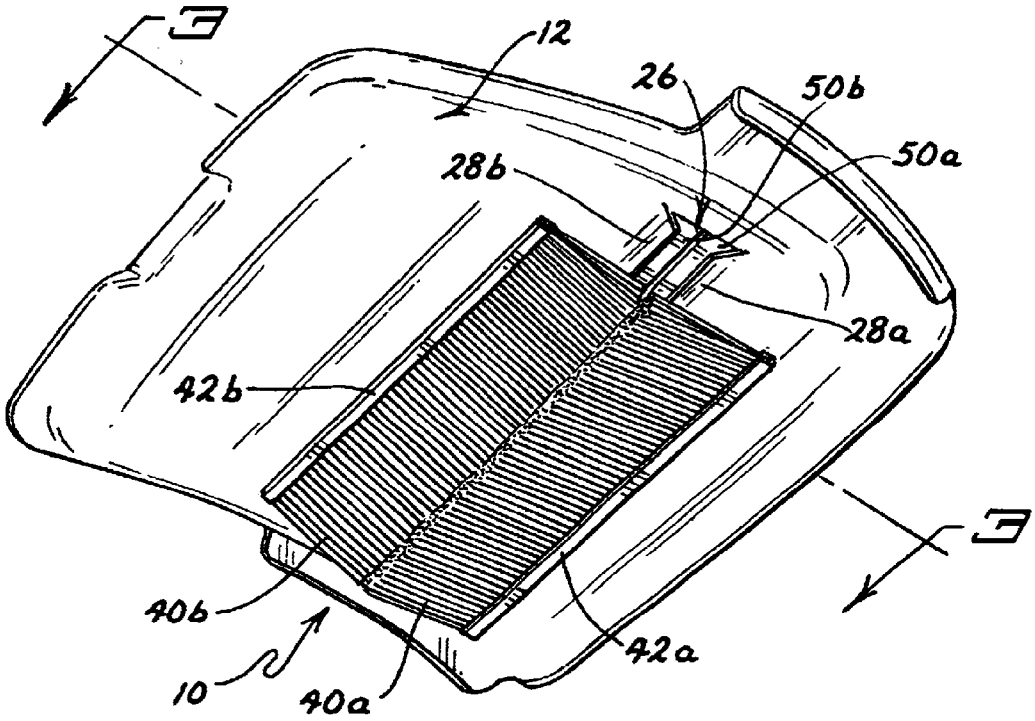
FIG. 2 is a perspective view of the underside of the trash can lid, showing portions of the lint screen cleaning device.
Figure 3:
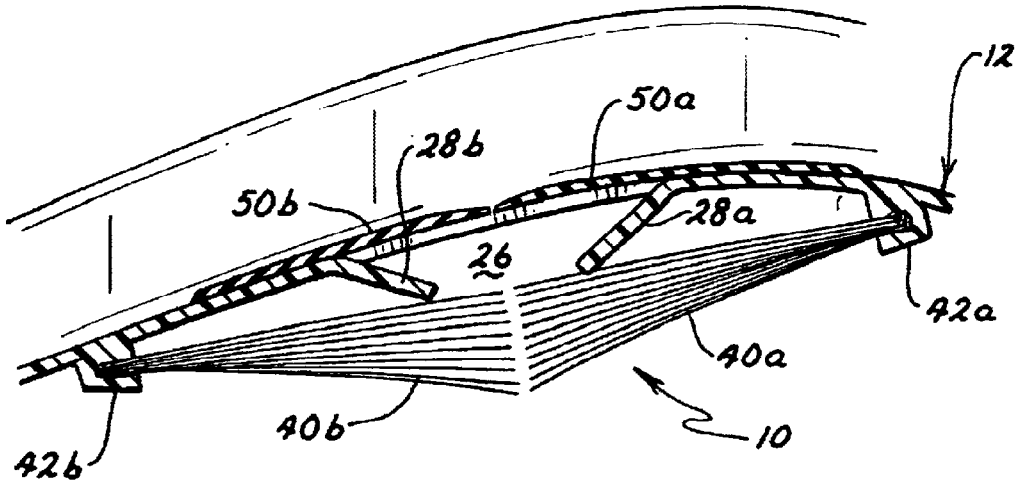
FIG. 3 is an enlarged side sectional view of a portion of the trash can lid and cleaning device shown in FIGS. 1 and 2, taken generally through line 3—3 of FIG. 2.
Figure 4:
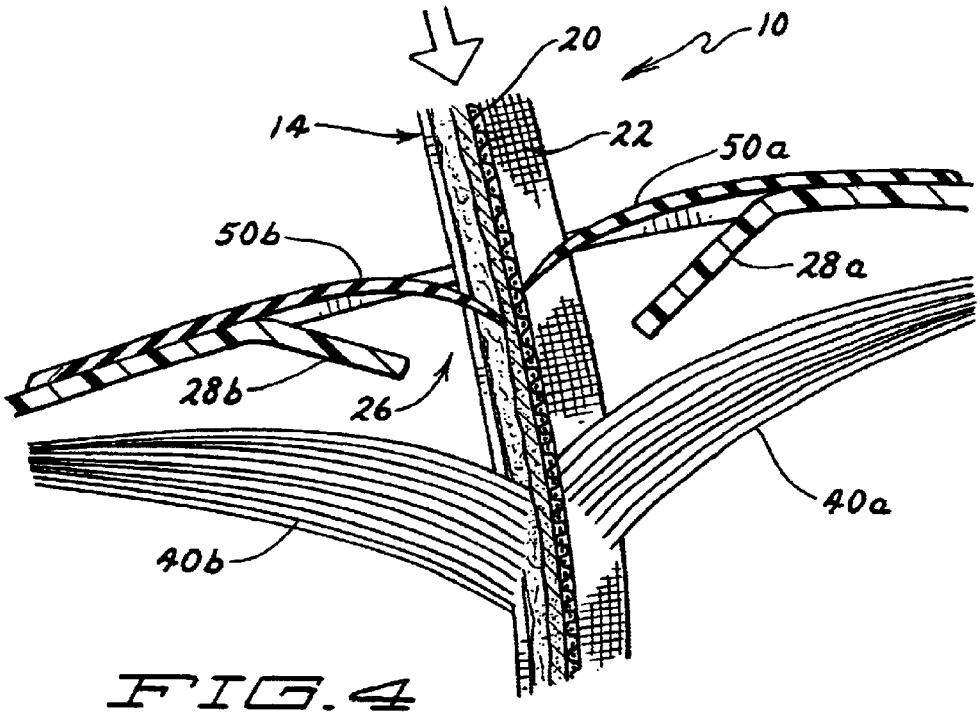
FIG. 4 is a further enlarged side sectional view of the lint screen cleaning device of FIG. 1, showing the dryer lint screen being inserted into the cleaning device.

With particular reference to FIGS. 2 and 3, lid 12 forms a lid slot 26 that is sized to accommodate lint screen 14, potentially among others. While lid slot 26 could be a simple two-dimensional rectangular slot formed in the top surface of lid 12, it is preferably formed by a pair of bristle supports 28 that angle inwardly and downwardly on either side of lid slot 26. Bristle supports 28 thus combine to form a tapering slot that is relatively wide at the top and progressively narrows toward the bottom. The dual function of bristle supports 28 is described at some length below.

In the preferred embodiment, slot 26 is about 13 inches long, i.e., slightly longer than the width of lint screen 14. Bristle supports are roughly ½ inch wide and extend the entire length of slot 26. They form an angle with the top surface of lid 12 of roughly 45 degrees. Slot 26 is about 1 inch wide at the top (i.e., at the top of lid 12), and about ½ inch wide at the bottom (i.e., at the lower edges of bristle supports 28). The specific dimensions and configuration of slot 26 and bristle supports 28 may vary depending on the types and sizes of lint screens to be cleaned.

Mounted to the underside of the lid, or frame, 12 are two sets of bristles 40*a* and 40*b*. Bristles 40, as further discussed below, constitute the media that actually strip the lint from the lint screen. Those skilled in the art will recognize that other types of "lint stripping media" could be used, depending on a variety of factors.

Each bristle set 40 can be mounted to lid 12 in any number of ways, e.g., by means of a molded, slotted boss 42. Alternatively, a suitable adhesive or fastener(s) could be used. Bristle sets 40*a* and 40*b* are mounted on either side of and beneath lid slot 26, with the bristles angling inwardly and downwardly (see FIG. 3) in a manner similar to the tapering of bristle supports 28, though the angle of bristles relative to the lid top surface is preferably only about 20 degrees. The tips of the bristles can touch or be slightly separated, depending on the bristle material and stiffness and the precise size and configuration of the lint screen to be cleaned. Plastic bristles are preferred, though other materials could conceivably be used. The bristles are preferably about 1⅜ inches long, measured from the mounting boss 42 to their inner tips. Bristle length may vary depending on many factors, including the chosen mounting technique and bristle stiffness.

The lower edges of the bristle supports 28 can engage bristles 40 toward their inner tips. Preferably the bristles are mounted and angled relative to the bristle supports such that the bristles 40 are bent slightly downwardly; that is, to create a slight preload on the bristles, though in some embodiments there needn't be a preload, nor even any contact between the bristle supports and the bristles, when cleaner 10 is not actively cleaning a lint screen.

Bristle supports 28 interact with bristles 40 in such a way that the bristles can be easily bent downwardly, but resist upward deflection. That is, since there is nothing supporting the outer tips of the bristles from below, they can easily deflect downwardly, essentially bending along their entire length. Especially if the bristles are made of plastic, and have a diameter of about 0.02 inch, as in the most preferred embodiment, they can easily bend downwardly. By contrast, the bristles are supported from above by bristle supports 28, making upward deflection considerably more difficult. Once the bristles contact bristle supports 28 their effective length changes from roughly 1¾ inches to roughly ½ inch. This creates a much stiffer bristle, in the upward direction. In effect, the bristles are shorter and thus stiffer in one direction than the other.

The rationale for this asymmetry or differential in how the bristles react, downwardly versus upwardly, will be explained below. Once the function of bristle sets 40 is understood, those skilled in the art will see that other materials and elements could be used in lieu of brush bristles, to create the desired asymmetrical effect.

Note that there are two opposing bristle sets in the preferred embodiment of the present invention, thus permitting the lint screen to be inserted either way, perhaps depending on the orientation of lid 12, and also perhaps to permit the user to switch from one set of bristles to another on occasion to prevent undue wear on the bristles, which might impair the lint stripping function.

Cleaner 10 can also includes a pair of flaps 50 mounted to the top surface of lid 12 atop lid slot 26. Flaps 50, extending the width of slot 26, preferably touch or nearly touch at their inner edges. Flaps 50 are optional since they preferably do not do much in the way of stripping lint off of the screen. Rather, preferred flaps 50 function primarily to seal container 13 to keep the stripped lint particles in the container and out of the room. That being the case, in the preferred embodiment flaps 50 can be very flexible, thin sheet rubber. Even though such flaps are primarily designed to prevent dust from escaping the container, they also help seal against odors and pests.

Figure 5:
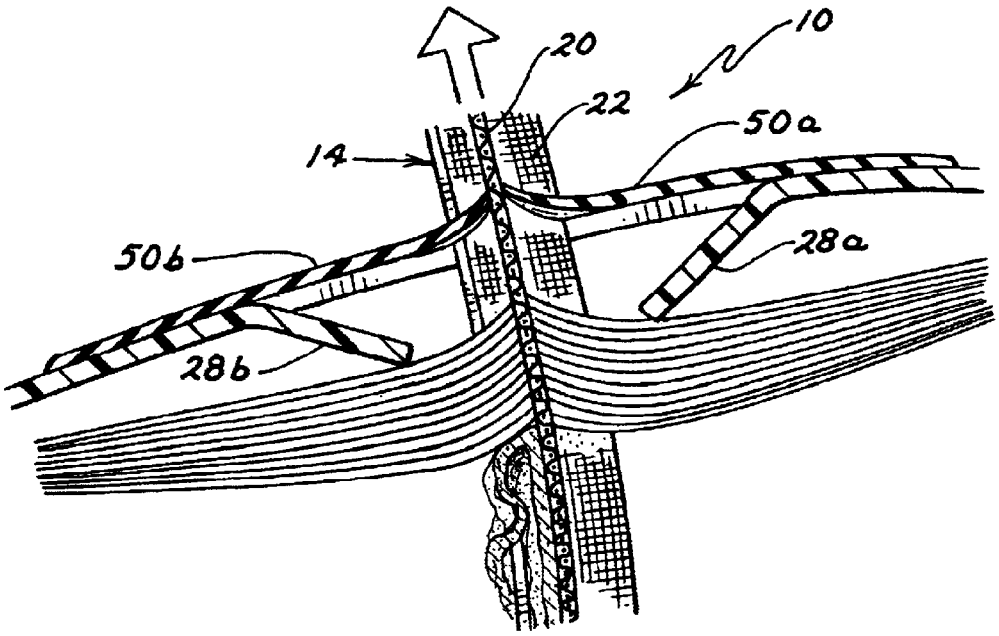
FIG. 5 is another enlarged side sectional view of the device of FIG. 1, showing the lint screen being withdrawn from the device.

Now that the preferred structure of lint screen cleaner 10 is understood, its operation can be described. When it is time to clean lint screen 14, and before starting the dryer 18, the operator lifts door 17 and reaches in to grasp lint screen handle 24. Lint screen 14 is withdrawn from pocket 16 and positioned in the manner shown in FIG. 1. Then filter 14 is inserted through flaps 50 and slot 26 into the interior of container 13. The lint stripping media, in the preferred embodiment bristles 40, yield enough so as to not strip the lint from the screen. Once the screen is fully inserted (i.e., when handle 24 is more or less flush with the top of lid 12), the operator can pull on handle 24 to withdraw screen 14 for container 13, as shown in FIG. 5. This causes the bristles to engage supports 28 and effectively stiffen such that they provide enough resistance to scrape or sweep the lint off of the upstream side of the screen. The lint falls into container 13 for subsequent disposal. The cleaned filter can be reinserted into dryer pocket 16 and the door closed, thus readying the dryer for normal operation.

Preferred embodiments of the invention are described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the claims which follow this detailed description, and equivalents thereto.

For example, the cleaner "frame," which in the preferred embodiment is a more or less standard trash can lid, could be mounted to other types of containers; that is, the container needn't be a trash can, per se. It could be any container or device for containing or disposing of the lint. Conceivably, the frame could be mounted to a container mounted in the wall of a house, or even to a container that is part of the dryer itself, or any other special or general purpose container or like device. Or, even if the trash can approach is used, there could be an additional, smaller container mounted to the underside of the lid to receive and contain the stripped lint. That way, the lint screen cleaning operation can proceed irrespective of the amount of trash in the main body of the trash can. Also, there could be a lint receiving bag attached to the underside of the lid, to receive the stripped lint, to prevent the screen from possibly coming into contact with the "general" trash, which might damage or contaminate the screen.

Broadly speaking, the "frame" of the device needn't be a container at all. Rather, the frame could be any structure capable of supporting the lint stripping media.

Similarly, the "lint stripping media" needn't be bristle. It could be anything that can strip lint off of a lint screen, preferably with an asymmetrical or differential action such that it permits the screen to be inserted without significantly disrupting the lint, but strips the lint upon removal of the screen from the cleaner. This differential action could be achieved in other ways. For example, the device could include one or more rollers coated with a lint stripping media such as radially extending bristles. The rollers could be mounted to the frame in such a way as to permit the rollers to freely rotate as the lint screen is being inserted, leaving the lint on the upstream side of the screen; and resist rotation as the screen is being withdrawn, so that the lint stripping media can remove lint from the screen as it is withdrawn.

Those skilled in the art will also recognize that that the bristles, or, more generally, the lint stripping media, could be equally stiff in both directions (i.e., not inherently "asymmetrical" or "differential"), with the user having to in effect create the asymmetry by modulating the clearance between the bristles and the lint. In this possible embodiment, the user would have to manually space the screen away the bristles during insertion, to minimize disruption of the lint going in; and then allow the bristles to contact the lint during withdrawal to strip the lint off of the screen.

Finally, it would be possible, and the present invention contemplates, combining the functions of the flaps and bristles, so that a single element provides some degree of sealing and also does the lint stripping.

As noted above, the invention is limited only to the apparatus and method recited in the claims which follow, and equivalents thereto.

I claim:

1. A device for removing lint from a dryer lint screen, comprising:

(a) a container assembly; and (b) a lint stripper operatively connected to the container, wherein the screen can be inserted into the container through the lint stripper without removing a significant portion of the lint, but upon withdrawal of the lint screen from the container the lint is substantially removed from the screen by the lint stripper and held within the container.

2. A device for removing lint from a dryer lint screen comprising:

(a) a container; and (b) a lint stripper assembly comprising a frame pocket and lint stripping media connected to the frame, wherein the frame is operatively connected to the container and the lint is removed from the lint screen by inserting the lint screen into the lint stripper assembly and then withdrawing it, whereupon the lint is stripped off of the screen by the media and collected within the container wherein the lint stripping media comprises a plurality of bristles, wherein the bristles comprise two sets of bristles facing toward one another and angled downwardly and inwardly.

3. The device according to claim 2, wherein the container comprises a trash can and the frame comprises a trash can lid.

4. The device according to claim 2, wherein:

a trash can lid forms a slot; and (b) one set of bristles is connected to the underside of the lid and positioned on one side of the slot, and the other set of bristles is connected to the underside of the lid and positioned on the other side of the slot.

5. The device according to claim 4, further comprising a pair of bristle supports connected to the trash can lid and located on either side of the slot, wherein one of the bristle supports is adjacent to and positioned above one of the bristle sets and the other bristle support is adjacent to and positioned above the other bristle set, whereby when the lint screen is inserted the bristles readily flex downwardly and do not appreciably strip lint off of the screen, but when the lint screen is withdrawn the bristles contact the bristle supports and do not flex upwardly as readily thereby stripping the lint off of the screen.

6. The device according to claim 4, further comprising a pair of adjoining flexible flaps connected to the top of the lid and located on either side of the slot, whereby the flaps seal the slot so as to prevent airborne lint from escaping the trash can once stripped off of the lint filter.

* * * * *